US006253493B1

(12) United States Patent
Sauve

(10) Patent No.: US 6,253,493 B1
(45) **Date of Patent: *Jul. 3, 2001**

(54) ADJUSTABLE BOTTOM SWEEP FOR A DOOR

(75) Inventor: Raymond Sauve, Stone Mountain, GA (US)

(73) Assignee: Albany International Corp., Albany, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/324,475

(22) Filed: Jun. 2, 1999

(51) Int. Cl.[7] ..... E06B 1/70
(52) U.S. Cl. ..... 49/470; 49/305; 49/489.1
(58) Field of Search ..... 49/470, 495.1, 49/490.1, 475.1, 467, 305, 304, 316, 489.1

(56) References Cited

U.S. PATENT DOCUMENTS 379,208 3/1888 Cosper .
1,147,836 * 7/1915 Allmand ..... 49/475.1
1,736,885 11/1929 Morrill .
2,329,791 * 9/1943 Sevison ..... 49/495.1
2,934,802 * 5/1960 Shekter ..... 49/470
2,949,651 8/1960 Hill .
3,139,652 7/1964 Michaels .
3,346,994 * 10/1967 Kesler ..... 49/470
3,374,580 * 3/1968 Ruff ..... 49/470
3,987,587 * 10/1976 Miller ..... 49/495.1
4,300,528 * 11/1981 Siemmons ..... 49/496.1
4,413,446 * 11/1983 Dittrich ..... 49/470
4,447,989 * 5/1984 Mailand et . ..... 49/495.1
5,150,544 9/1992 Burnett .
5,326,592 * 7/1994 Goewey et al. ..... 427/256
5,465,532 * 11/1995 Varin ..... 49/470
5,469,665 * 11/1995 Biebuyck ..... 49/470
5,675,935 * 10/1997 Lin ..... 49/470

* cited by examiner

*Primary Examiner*—Daniel P. Stodola
*Assistant Examiner*—Curtis Cohen
(74) *Attorney, Agent, or Firm*—Pitney, Hardin, Kipp & Szuch, LLP

(57) ABSTRACT

A door sweep includes a holder and a plurality of astragals extending from the holder. The holder has a generally U-shaped cross-section defining a cavity for receiving a portion of a door. The astragals are provided with tongues, which are received in grooves of the holder.

11 Claims, 4 Drawing Sheets

ADJUSTABLE BOTTOM SWEEP FOR A DOOR

BACKGROUND OF THE INVENTION

1. Field of the Invention

The present invention relates generally to a door sweep, and, more particularly, to an adjustable door sweep for a freezer or cooler door. The door sweep includes a holder, which has a plurality of receiving grooves each for receiving one of a plurality of astragals and/or astragal positions.

2. Description of the Prior Art

The doors of freezers, refrigerators and coolers generally require a sealing device to separate the interior thereof from the ambient environment to increase efficiency of such devices and decrease operating costs, including energy costs. Such doors for freezers, refrigerators and coolers are swing-aim doors. Roll-up doors are not used in such applications in certain countries, particularly the United States, for example, because condensation may drip onto food when it is transported to and from the freezer and passes under a roll-up door.

U.S. Pat. No. 379,208 to Cosper describes a weather stripping, which includes a strip of a flexible material longitudinally looped around a wire or other filament. A thin metallic strip is formed around the flexible strip to embrace the looped portion. The weather stripping is affixed to a door by nails or tacks through the thin metallic strip. The flexible material may be further folded upon itself, the nails or tacks affixing the weather stripping to the door through both the thin metallic strip and the folded portion of the strip of flexible material.

U.S. Pat. No. 1,736,885 to Morrill describes a detachable weather strip having elongated eyelets disposed along the length thereof. The eyelets are provided for receiving studs, which are mounted on a door. The head of each stud is of size and configuration to be rotated by one-quarter turn to lock the weather strip to the door.

U.S. Pat. No. 2,949,651 to Hill describes a weather stripping, which includes a weather strip and a housing. The weather strip has a series of fins or flaps disposed on the underside thereof. The housing is attachable to the bottom surface of a door by screws, nails, staples or other fasteners. The housing includes a pair of troughs for receiving the pair of beads of the weather strip so that no nails, screws or other fastening devices are needed to secure the weather strip to the housing.

U.S. Pat. No. 3,139,652 to Michaels describes a pair of astragals for weather stripping doors. The first astragal includes a pile at the exposed outer edge thereof, and the second astragal includes a flat metal surface on the exposed outer edge thereof. When the door is in the closed position, the pile of the first astragal and the flat metal surface of the second astragal are facing and abutting.

U.S. Pat. No. 5,150,544 to Burnett describes a magnetically mounted door sweep, which includes a seal portion mounted on a door-engaging portion. The door-engaging portion includes a substantially planar surface, which is magnetically attached to a metallic door.

SUMMARY OF THE INVENTION

It is an object of the present invention to provide a door sweep, which minimizes air infiltration between the interior and exterior of the door. It is a further object of the present invention to provide a door sweep for a refrigerator, freezer or cooler that increases efficiency and decreases operating costs of the refrigerator, freezer or cooler.

It is a further object of the present invention to provide means for exchanging an astragal of a door sweep to repair or replace the astragal with minimum effort.

It is still another object of the present invention to provide a door sweep that allows adjustability during its operating life.

These and other beneficial objects of the present invention are most effectively attained by providing a door sweep, which includes a holder that can be mounted on a door and a plurality of flexible astragals mounted on the holder.

DETAILED DESCRIPTION OF THE PREFERRED EMBODIMENTS

Figure 2:
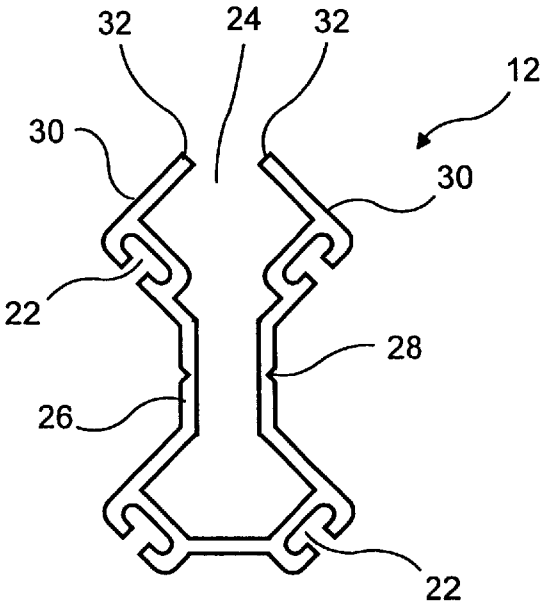
FIG. 2 is a side elevational view of a holder of the door sweep illustrated in FIG. 1.
Figure 1:
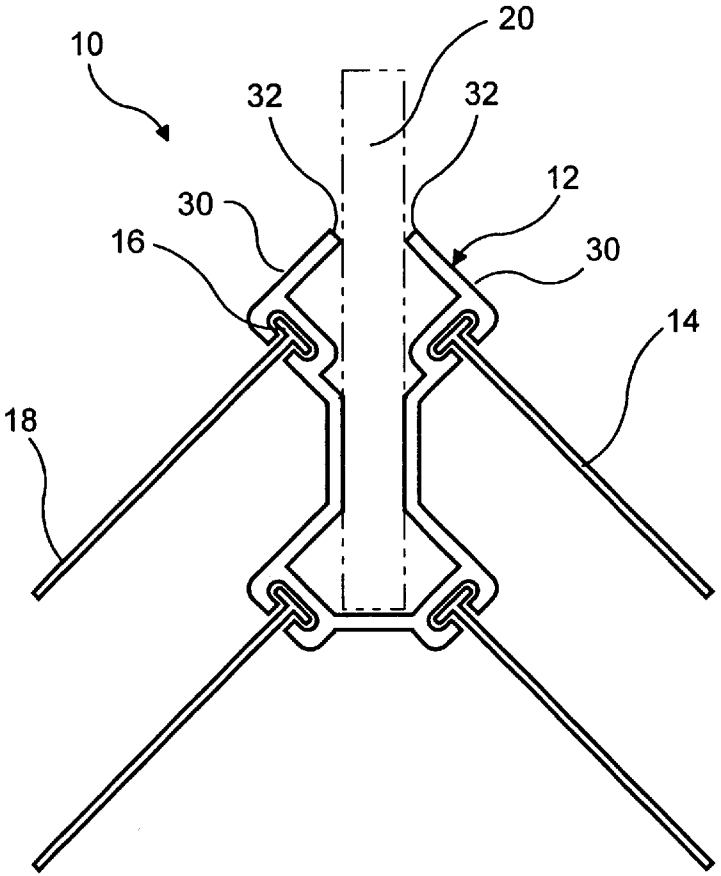
FIG. 1 is a side elevational view of a door sweep according to the present invention.

Those skilled in the art will gain an appreciation of the present invention when view in conjunction with the accompanying drawings of FIGS. 1 and 2, inclusive. The individual reference characters designate the same or similar elements throughout the several drawings.

Referring to FIG. 1, there is seen a side elevational view of a door sweep 10 according to the present invention. Door sweep 10 includes a holder 12 and one to four astragals 14. In FIG. 1, the door sweep 10 is shown mounted on the bottom of a door 20, which is shown in phantom. The door 20 may be a PVC door. It will be appreciated that a gap will exist between the bottom of the door 20 and the sill of the door frame, not shown, and between the top of the door 20 and the header of the door frame, also not shown. Because door sweep is particularly suitable for use in conjunction with a door 20 of a freezer, refrigeration device or cooler, holder 12 is made of any material suitable for low-temperature, high-impact environments. Preferably, holder 12 is formed of an acrylonitrile-butadiene-styrene (ABS) plastic extrusion. Each astragal 14 is formed of a resilient material, such as a soft, flexible SANTOPRENE which is a rubber product. Such material is designed to remain flexible and has superior abrasion resistance properties. Each astragal 14 includes a flexible mating part 18 and a tongue 16. Preferably, the flexible mating part 18 and tongue 16 are integrally formed to form a one-piece astragal 14.

Referring now to FIG. 2, there is seen a side elevational view of holder 12. Holder 12 includes four grooves 22, each for receiving the tongue 16 of one of the four astragals 14 as illustrated in FIG. 1. As illustrated in FIG. 2, the cross-section of holder 12 is generally U-shaped, having a cavity 24 for receiving the bottom of the door 20. The two upright arms 26 of the U-shaped cross-section of holder 12 are angled inwardly to provide a clamping force on the door 20 to maintain holder 12 on door 20 minimizing the use of screws, nails, tacks or other fastening devices. The upright arms 26 may further include a groove 28 running along the length of holder 12 for centering a screw or other fastening device when such screw or other fastening device is used to secure holder 12 to door 20. The flexibility of the astragals 14 readily permits the same to match the contour of the floor or bottom of the door opening. The tongue-and-groove configuration of the holder 12 and astragal 14 provides simple replacement of a worn astragal 14. Except for replacement of a worn astragal 14, the door sweep 10 is substantially maintenance free.

The geometry of holder 12, shown in FIGS. 1 and 2, is preferred because the holder 12 is provided with opposing edges 30, each having a crimp edge 32. The edges 30 are angled relative to the door 20, as shown in FIG. 2, so that any condensation forming on the surface of door 20 will run off and away from the cavity 24 and to generally provide that the holder 12 will tend to slide off an object upon an impact to the holder 12. Additionally, the crimp edges 32 are urged against the surfaces of the door 20, thereby further enhancing the seal of the cavity 24.

It will be appreciated that the above-described embodiment of the present invention includes four astragals 14, any number of astragals 14 may be provided. Additionally, although FIG. 1 illustrates two astragals 14 on each of the interior and exterior sides of the door 20, the astragals 14 may alternatively be provided on only one of the interior and exterior sides of the door 20.

Figure 3C:
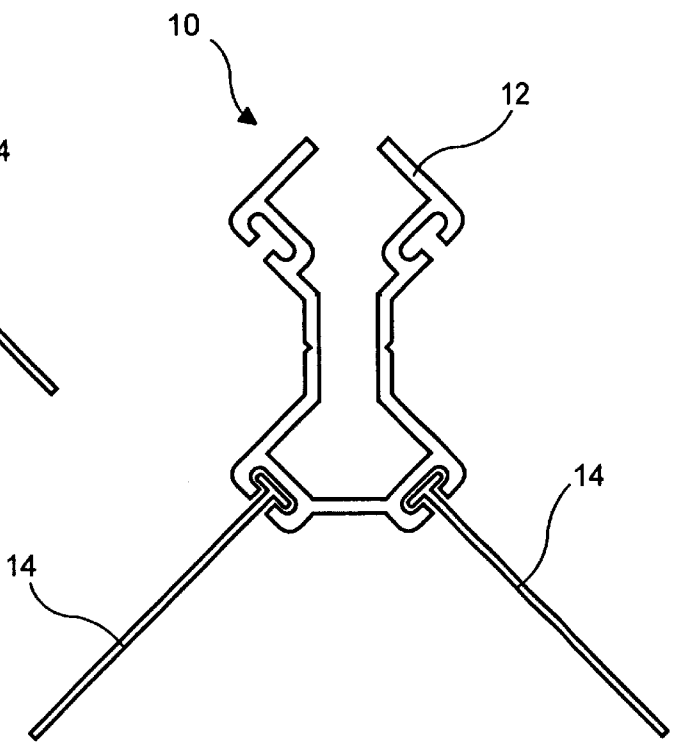
FIGS. 3A–3C are side elevational views of alternative embodiments of the door sweep illustrated in FIG. 1.
Figure 3B:
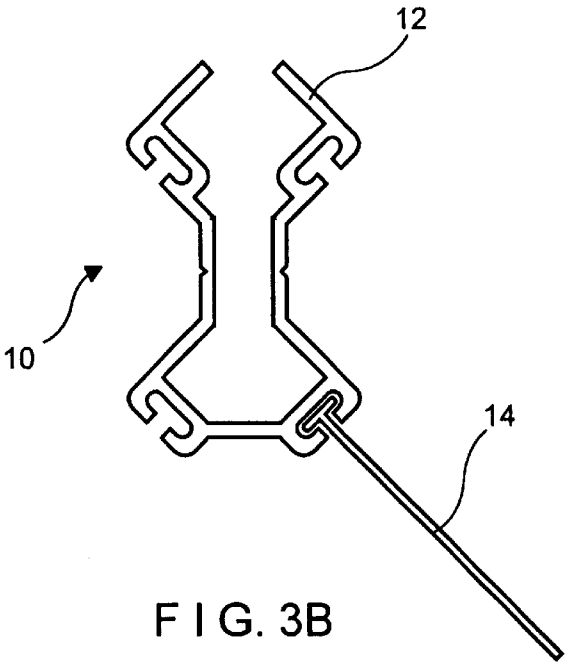
Figure 3A:
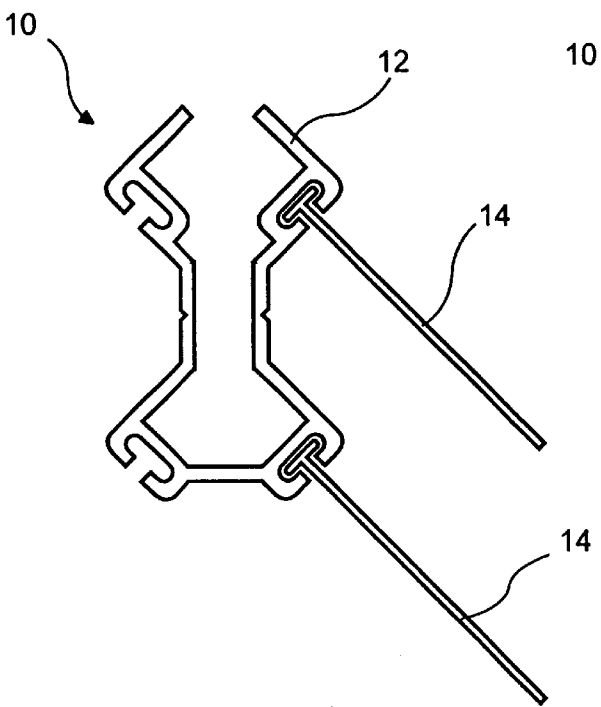
Figure 4B:
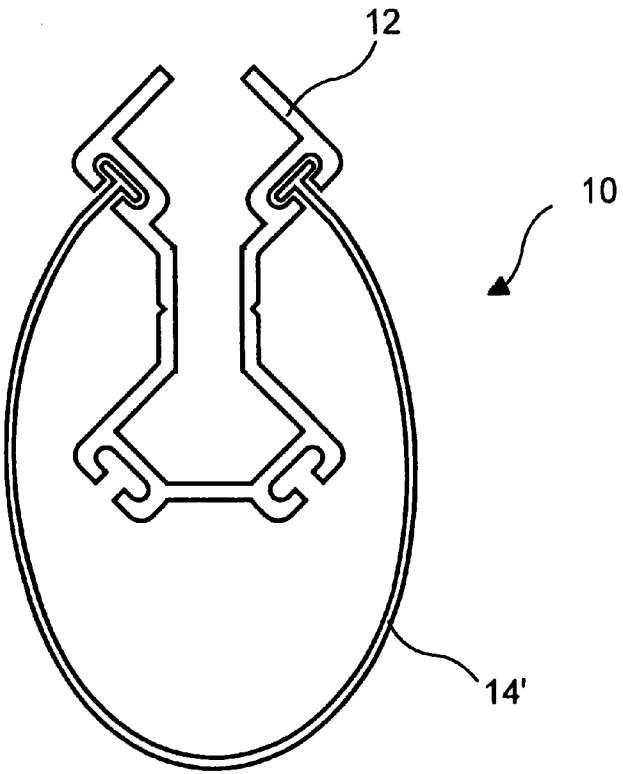
FIGS. 4A–4D are side elevational views of further alternative embodiments of the door sweep illustrated in FIG. 1.
Figure 4A:
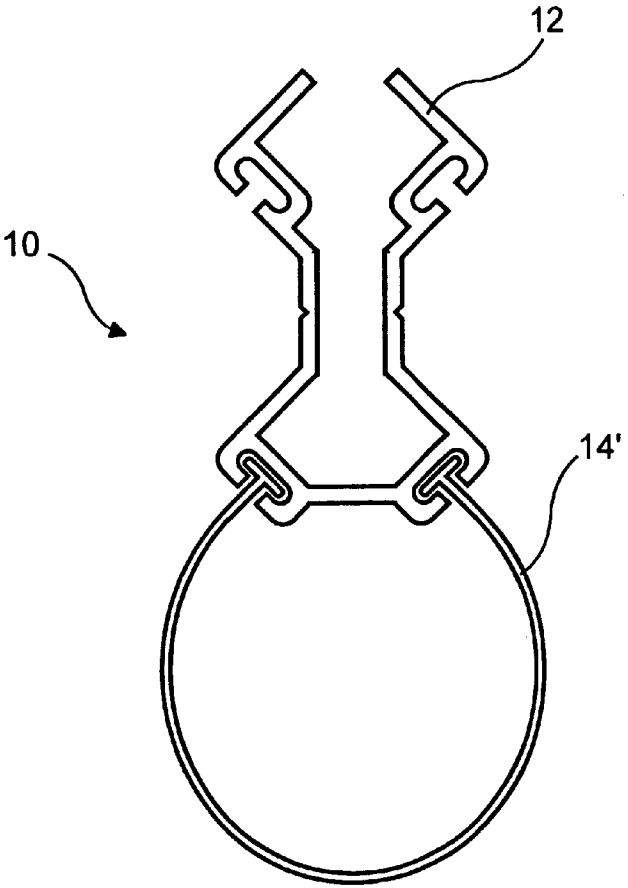
Figure 4D:
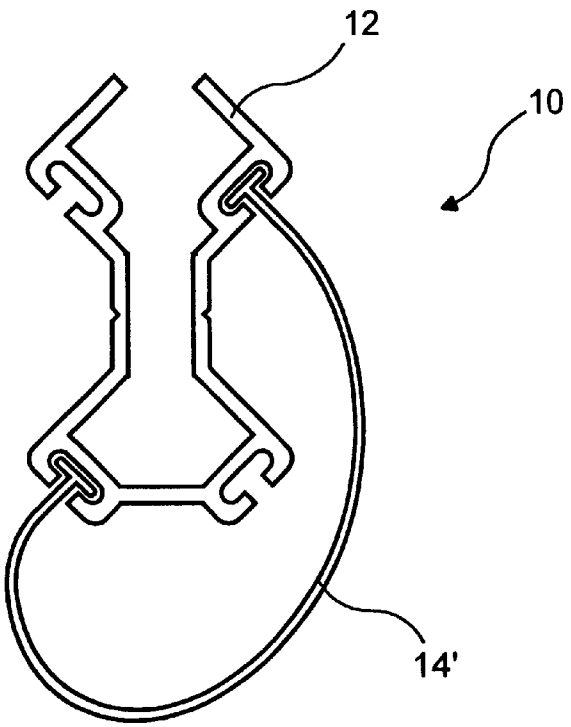
Figure 4C:
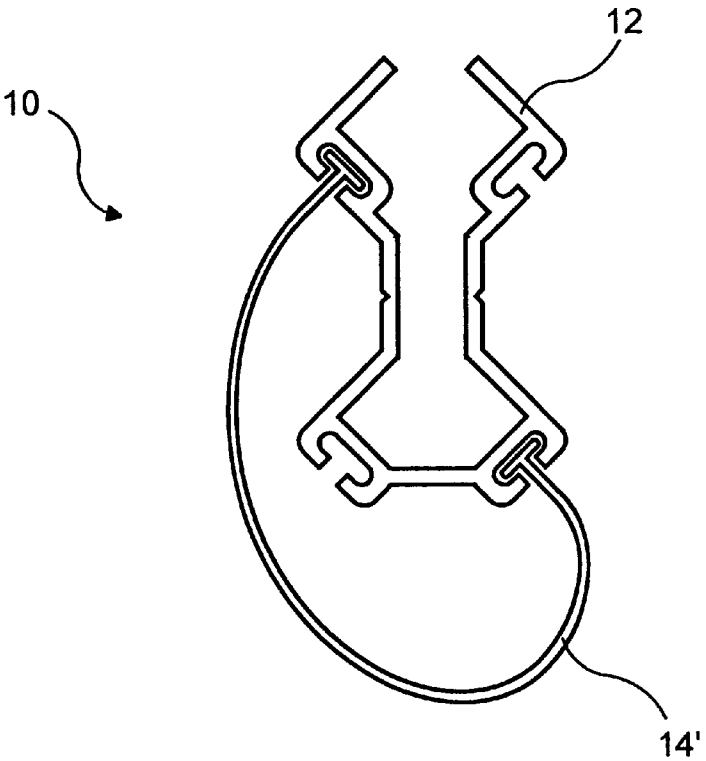

Referring now to FIGS. 3A–3C, there is seen side elevational views of alternative embodiments of the door sweep 10 shown in FIG. 1. More particularly, FIG. 3A illustrates a door sweep 10 having two astragals 14, each mounted on one side of the holder 12. FIG. 3B illustrates door sweep 10 having single astragal 14 mounted on a lower one of the four grooves 22. FIG. 3C illustrates door sweep 10 having two astragals 14, each mounted on the lower grooves 22.

Referring now to FIGS. 4A–4D, there is seen side elevantional views of further alternative embodiments of door sweep 10. Astragal 14' has two tongues 16 formed at the ends thereof, each engageable with the grooves 22. Each of FIGS. 4A–4D illustrates one of the possible mounting arrangement of astragal 14' in holder 12.

It will be appreciated that the astragals 14, 14' may be adjusted to accommodate changes in the size of the gap between the door 20 and the frame of the door, such as changes caused by expansion and contraction of the door 20.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A sweep and a door, comprising:

a holder being mounted on lateral sides of an exterior of the door, said holder including a first side and a second side and further including a plurality of grooves;

said holder having generally a U-shaped cross section with flexible upright parellel arms forming a gap therebetween, said gap being less than the width of said door, before the sweep is attached to said door, such that the arms are biased apart when attached to said door so as to provide a clamping force on the lateral sides of the exterior of the door which maintains said holder on the door whilst allowing for longitudinal and vertical adjustment thereof; and at least one flexible astragal extending from said holder, said astragal having at least one end having a tongue inserted into one of said plurality of grooves.

2. The sweep according to claim 1, wherein said U-shaped cross section includes upright arms which further include a groove running along a length of said holder for receiving a fastener for fastening said holder to said door.

3. The sweep according to claim 1, wherein said astragals are provided on one of a first side and a second side of the sweep.

4. The sweep according to claim 1 wherein said astragals are provided on a first side and a second side of the sweep.

5. The sweep according to claim 1, wherein said holder is formed of a plastic material.

6. The sweep according to claim 5, wherein said plastic material is an acrylonitrile-butadiene-styrene material.

7. The sweep according to claim 1, wherein each of said astragal is formed of a rubber material.

8. The sweep according to claim 1, wherein upright arms of said U-shaped cross-section are angled inwardly.

9. The sweep according to claim 1, wherein said astragal extends at an angle of approximately 45-degrees from said holder.

10. The sweep according to claim 1, wherein said at least one flexible astragal comprises a single astragal having tongues forms at both ends, one of said tongues being inserted into a groove disposed on an interior side of said door and the other of said tongues being inserted into a groove disposed on an exterior side of said door.

11. A sweep for a door, comprising:

a holder being slidingly mountable on lateral sides of an exterior of the door, said holder including a first side and a second side and further including a plurality of grooves; and at least one flexible astragal extending from said holder, each astragal having at least one end having a tongue inserted into one of said plurality of grooves;

wherein said plurality of grooves includes four grooves, each of said four grooves including one of said at least one astragal, each said at least one astragal having said tongue on only one end thereof, said holder being adapted to provide two of said corresponding astragals on said first side of the sweep and two of said corresponding astragals on said second side of the sweep.

* * * * *